US009919778B2

(12) United States Patent
Lee et al.

(10) Patent No.: US 9,919,778 B2
(45) Date of Patent: Mar. 20, 2018

(54) ANTI-CUTTING AIRBAG

(71) Applicant: William Wei Lee, Shanghai (CN)

(72) Inventors: William Wei Lee, Arcadia, CA (US); Qingling Duan, Jinan (CN); Guangfeng Yu, Jinan (CN); Dianhua Zhao, Jinan (CN)

(73) Assignee: Shandong Nanhai Airbag Engineering Co. LTD., Jinan, Shandong (CN)

( * ) Notice: Subject to any disclaimer, the term of this patent is extended or adjusted under 35 U.S.C. 154(b) by 364 days.

(21) Appl. No.: 14/848,040

(22) Filed: Sep. 8, 2015

(65) Prior Publication Data

US 2017/0066513 A1 Mar. 9, 2017

(51) Int. Cl.
*B63C 3/02* (2006.01)
*B63C 3/10* (2006.01)

(52) U.S. Cl.
CPC . *B63C 3/10* (2013.01); *B63C 3/02* (2013.01)

(58) Field of Classification Search
CPC ..... B63C 3/02; B63C 3/10
See application file for complete search history.

(56) References Cited

U.S. PATENT DOCUMENTS

2016/0129646 A1* 5/2016 Cadogan ..... B29C 70/446 425/135
2017/0167096 A1* 6/2017 Obermeyer ..... E02B 7/20

* cited by examiner

*Primary Examiner* — Arti Singh-Pandey
(74) *Attorney, Agent, or Firm* — Liu Law Group, pllc; Tim Liu

(57) ABSTRACT

Conventional ship launching airbags are made of several layers of rubber and fiber meshes bonded together by vulcanization. With the existing fabrication process, an airbag is strong in standing heavy pressure at its surfaces, but weak against the cutting by sharp edges of metal debris or oyster shells. An airbag's functional failure during a field operation can cause not only stoppage, but also explosion, hence a serious safety hazard. To overcome such structural weakness, a new type of airbags with anti-cutting capability is disclosed in which a conventional ship launching airbag is covered with a layer of anti-cutting armor made of steel cord ply sheets, a standard off-the-shelf product for the making of tires, embedded at the surface of the airbag's main body.

21 Claims, 8 Drawing Sheets

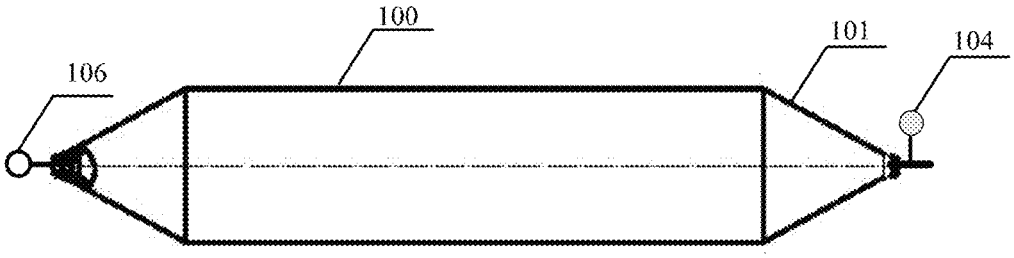
FIG. 1 A（Prior Art）
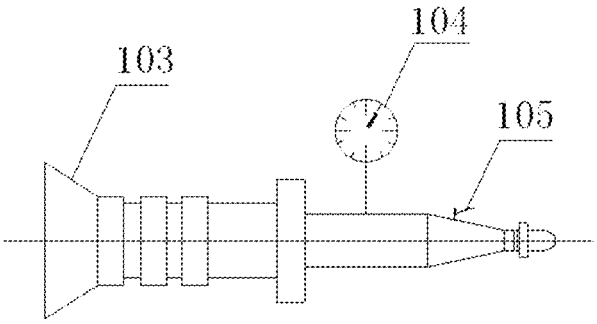
FIG. 1 B（Prior Art）

A - A

ANTI-CUTTING AIRBAG

FIELD OF THE INVENTION

The disclosure relates generally to fabrication process of airbags.

BACKGROUND OF THE INVENTION

Ship building at sand beaches started in the 1980's in Southern China. When building a ship at sand beaches, ship builders place wooden blocks on a sloped sand beach and start ship construction on top of these wooden blocks using land cranes. After the construction is complete, ship launching airbags, shown in FIGS. 1A and 1B, will be placed under the ship keel longitudinally between every two rows of the wood blocks. Inflating these airbags, the ship would be lifted off these wooden blocks. After the lifting operation, the wooden blocks will be then removed from under the ship keel. Once the holding lines are cut, the ship will be launched toward the sea along the slope with the rolling of these airbags. Before the launching, best efforts will be made to thoroughly search and remove metal debris from the site in order to protect the airbags. However, some steel debris with sharp edges will still escape the search and remain on the slope, and they can cut the rolling airbag and cause an explosion. In some cases, such explosion ended up in personal injury or even death.

The application of ship launching airbags has been broadened to other areas including ship repair in China and Southeast Asia. In an operation of pulling an old oceangoing ship onshore for repair and maintenance, a reverse operation of ship launching, some deflated airbags are placed at a sloped underwater floor and under the ship keel. There is a simultaneous combined operation of air injection and pulling of the ship onshore. During the pulling operation, airbags may be cut by the sharp edge of underwater metal debris on the sloped floor and/or the barnacles of oyster shells at the ship bottom, resulting in explosion accidents. Such accidents actually happen a lot, almost in every ship pulling operation.

Another newly-developed application of airbags is ship salvaging. During a ship salvaging operation airbags often face similar threats of cutting by various sharp edged objects inside the wrecked ship. For example, deflated airbags may be placed by divers at several designated locations inside the ship's cabin rooms. After connecting with a control system for air injection, airbags will produce a large amount of buoyancy and apply a high pressure force over a large area at one side of a cabin room. Sharp edged objects, such as the head of a cabin sprinkler at the ceiling, and/or damaged metals with sharp edges hanging at side walls, can cut and blow up the pressured airbags.

Similar to a pressured automobile tire, a pressured ship launching airbag may be damaged by these actions: cutting, puncturing and chopping. With automobile tires, the current designs have overcome the cutting and chopping issues by adding several layers of steel wires configured in cord plies embedded between two rubber sheets. Puncturing by a nail or other pointed sharp objects remains to be one un-resolvable issue for a tire. For ship launching airbags, however, the primary factor to cause its functional failure during various field applications is the cutting action by a sharp edge directly at the surface of a pressured airbag.

In most field applications, a cutting damage is the primary factor to cause the functional failure of a conventional ship launching airbag, usually leading to an explosion with considerable safety hazards. It becomes urgent and necessary to add an anti-cutting capability to ship launching airbags in order to eliminate potential safety hazards, while maintaining all its functionality in field applications.

OBJECTIVES AND SUMMARY OF THE INVENTION

The objective of this invention is to develop a new type of ship launching airbags which maintain the basic properties of the existing airbags while adding the anti-cutting capability. In order to achieve this objective, three steps are taken in the fabrication process of this new type of ship launch airbags:

1. Cover the entire surface of an airbag's middle section with many small steel cord ply pads. The small pads are disconnected from each other with a designed gap in between. The steel cords of all the pads are oriented parallel to the airbag axis. In such an arrangement, each pad contributes very little stiffness in the circular direction and limited stiffness in the axis direction due to the elasticity provided by the gaps and the elastic bonding between rubbers and steel cords. The gaps between pads must not be perpendicular to the airbag axis. As a result, this new type of anti-cutting airbag can maintain the same basic properties as a conventional ship launching airbag, while adding the anti-cutting property.

2. The shape and the size of the pads are important factors to determine the basic properties of the new anti-cutting airbag. In one preferred embodiment, the pads use radial cord ply sheet, the pad size in the circular direction can be long. However, the size in the airbag axis direction has to be narrow in order to have enough number of gaps to provide elasticity compatible with the rubber material and the fiber meshes during both contraction and expansion actions of the airbag. The pad may be in various shapes, such as rectangle, equilateral triangle, parallelogram, hexagon of equal sides, and hexagon of unequal sides (with four sides longer than the other two). A honeycomb pad configuration is selected as the preferred option, because pads with a hexagon shape is easy to be produced with high efficiency and the gaps between pads are easy to be controlled to avoid vulnerable straight gaps. In one preferred embodiment, the dimension of any pad in parallel to the airbag axis direction is less than 300 mm, or 1 foot, if radial cord ply is used. The dimension of any pad perpendicular to the airbag axis direction is less than 150 mm, or half foot, if biased cord ply is used.

3. The gap sizes are also one of the critical factors for an anti-cutting airbag. In one preferred embodiment, the minimum gap size is larger than 4% of the maximum pad dimension in the airbag axis direction if radial cord ply is used; and larger than 6% of a pad's maximum dimension in the airbag circular direction if biased cord ply is used.

In another embodiment, multiple layers of radial steel cord ply sheets are utilized within each shaped pad to reinforce anti-cutting protection.

For the utilization of a biased steel cord ply sheet for making hexagon shaped pads, a smaller pad dimension, especially in the circular direction, and a larger gap size compared with pads using radial steel cord ply sheet, should be considered.

BRIEF DESCRIPTION OF THE DRAWINGS

The drawings described herein are for illustrating purposes only of selected embodiments and not all possible implementations, and are not intended to limit the scope of the present disclosure. For further understanding of the nature and objects of this disclosure reference should be made to the following description, taken in conjunction with the accompanying drawings in which like parts are given like reference materials, and wherein:

FIG. 1A is a side view of a conventional ship launching airbag;

FIG. 1B is a side view of the steel part of a front end cone structure with additional attachments such as a removable pressure meter and an air valve. For the back end steel cone, the drawing is omitted, since it is similar to the front end, except for a ring attached at the end and without the pressure meter and the air valve;

DETAILED DESCRIPTION OF THE EMBODIMENTS

Figure 2A:
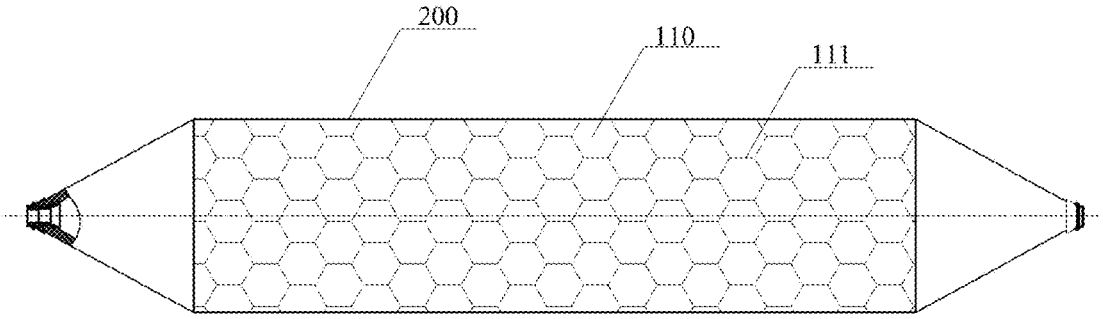
FIG. 2A is a side view of an anti-cutting airbag with honeycomb pad layout to cover the entire surface of the middle section and with designed gaps between pads.

Before explaining the disclosure in detail, it is to be understood that the system and method is not limited to the particular embodiments and that it can be practiced or carried out in various ways.

There are two types of standard steel cord ply sheets for tires. One type is called biased cord ply sheet with two layers of steel wires crossly knitted as one mesh and then sandwiched by two un-vulcanized thin rubber sheets. Another type is called radial cord ply configuration with only one layer of steel wires laid closely side by side with each other in parallel sandwiched by two un-vulcanized thin rubber sheets. Both types are the standard off-the-shelf products for tire manufacturing industry. For a biased cord ply sheet, the steel wire stiffness governs the whole cord ply sheet stiffness in all directions. For a radial cord ply sheet, the steel wire stiffness only governs the cord ply sheet stiffness in the direction parallel to the steel cord direction. In the direction perpendicular to the steel cords, only the rubber material stiffness governs which is much softer than the steel wire stiffness. Both types of steel cord ply sheets are considered in this disclosure as the added armor for the making of an anti-cutting airbag.

Conventional Fabrication Process for a Ship Launching Airbag

Ship launching airbags have become a mature and off-the-shelf type of products utilized in many industries with excellent properties, such as light weight, durability, capability of being deflated and rolled up for easy transportation, producing a large amount of buoyancy, and the ability to take heavy loads with a high internal pressure.

Referring to FIG. 1A and FIG. 1B, a conventional ship launching airbag 100 comprises a tubular middle section and two cone-shaped ends. The length of the middle section varies according to the requirements of each application. The middle section is made of natural rubber sheets and multiple layers of polyester fiber meshes bonded together through vulcanization. At the cone-shaped front end 101, there are several items such as a valve 105 for air inlet and exit, a removable air pressure meter 104 and a steel cone structure 103 covered with rubber and fiber mesh layers on the cone surface. At the other cone-shaped back end 101, there are several items such as a steel ring 106 for handling the airbag and a steel cone structure 103 covered with rubber and fiber mesh layers on the cone surface. The main body of the middle section and the surfaces of the two cone-shaped ends are made of several rubber layers mixed with layers of polyester fiber meshes. In most cases, only the middle section of a ship launching airbag have any contact with other objects and the two cone-shaped ends are designed to have no contact with any other objects. With this assembly, a conventional ship launching airbag 100 becomes a flexible pressured vessel.

When an air bag is assembled, it will be put into a sealed container injected with high temperature steam for a designed period of time for vulcanization. During the vulcanization process, the rubber layers become tightly bonded with the steel cone surfaces at both ends as well as with the layers of polyester fiber meshes over the entire length of the air bag.

All different anti-cutting airbags mentioned in this disclosure are generally based on the modification in a conventional ship launching airbag fabrication process by adding different types of pads at airbag middle section surface functioning as an anti-cutting amour.

The Issue of Elasticity Compatibility Between a Fiber Mesh Layer and a Steel Cord Ply for an Anti-Cutting Airbag Attempts were made to cover a ship launching airbag with one layer of large pieces of radial cord ply sheets or of biased cord ply sheets over the entire surface of the airbag middle section. However, the test produced some unsatisfactory results as follows:

1. The stiffness of a steel cord ply sheet is much higher than that of the fiber meshes and rubber material of an airbag. During the vulcanization process for a conventional ship launching airbag, rubber material will usually contract about 5-6% in both longitudinal and circular directions. And when a ship launching airbag is inflated to the normal operational internal pressure for field applications, the airbag will expand about 6-8% in both longitudinal and circular directions.

The fiber meshes, typically made of crossly knitted polyester fibers, are usually as elastic as the rubber material during vulcanization as well as when inflated for field applications. Therefore, there will not be any visible deformations on the surface of the airbag during the vulcanization process and during inflation for different field applications. However, it becomes a totally different story when a conventional ship launching airbag is covered with large pieces of steel cord ply sheets. Because of the different degrees of elasticity, the vulcanized airbag surfaces are all seriously twisted at the middle section, thus losing the desired bonding effect of the vulcanization between the steel wires and rubber material, making the airbag unusable for any intended applications.

2. Too stiff for bending with large pieces of either a biased steel cord ply sheet or a radial steel cord ply sheet—the finished airbag with a twisted surface also become too stiff to be bended or rolled up for easy transportation.

3. Too stiff for circular expansion with large pieces of biased steel cord ply sheet, but NOT so for a radial steel cord ply sheet if the steel cord direction is in parallel with the airbag axis. In other words, it loses its proper elasticity in circular direction with a biased steel cord ply sheet for any intended application. However, some tests indicate that the elasticity of the original airbag stiffness in circular direction is still maintained, if pieces of a radial steel cord ply sheet are used with the steel cord direction in parallel to the airbag axis.

Disclosed Fabrication Process can Reduce the Stiffness of the Embedded Radial Steel Cord Ply Sheet to Provide an Effective Anti-Cutting Amour for a Ship Launching Airbag Clearly, the radial cord ply sheet is a better choice comparing with a biased cord ply sheet. However, the stiffness of the large pieces of radial cord ply has to be reduced significantly in order to be compatible to the stiffness of the other layers of fiber meshes and rubber material for both vulcanization and operational inflation in the direction of the airbag axis. The following is a set of steps we took to reduce the stiffness of the large pieces of radial cord ply sheets:

Cut the large pieces of radial core ply sheet into small pads, place the small pads side by side to cover the entire surface of an airbag middle section, fill the gaps between adjacent small pads with rubber strips, then place a piece of rubber sheet on top of these small pads prior to going through vulcanization. This way, the stiffness of the radial cord ply is compensated for by the gaps between the small pads to provide the desired degree of elasticity of the anti-cutting amour as a whole. In other words, the size of each pad has to be small enough so that the rubber-to-steel bonding of the small pads plus those rubber strip-filled gaps can still leave sufficient flexibility to accommodate the contraction action during vulcanization and the expansion action under operational inflation. In addition, the finished airbag with reduced stiffness can be bended and rolled for easy transportation.

The small pad may be in different types of shapes: 1) rectangle, with the steel cords parallel to the narrow sides of the pad; and 2) various shapes of equal side lengths or unequal side lengths including, parallelogram, triangle, and hexagon.

No matter which type of shape is adopted, there are four key points in arranging these pads properly. First, the longest side in airbag axis direction, of no matter which shape, should be limited to be less than 300 mm or 1 foot in accordance with one preferred embodiment. Second, the gap size between any two adjacent pads should be properly designed in order to compensate not only for the contraction action during the airbag fabrication, but also for expansion action during inflation for field application. Third, steel cords in all the pads should all be oriented in the same direction as the airbag's axis for optimal anti-cutting protection, because cuttings happen mostly in perpendicular to the airbag axis. Fourth, none of the gaps should be perpendicular with the airbag axis, and the dimension of all the gaps should be maintained the same throughout the entire middle section area. Rubber strips should be utilized to fill the room of these gaps before covering the whole middle section area with a rubber sheet and going through vulcanization.

The gap size is one important design parameter and the selection of proper gap size should be a balance between a minimized gap size and acceptable elasticity of the radial cord ply sheet as a whole. According to one preferred embodiment, the minimum gap size should be larger than 4% of a pad's maximum dimension in the airbag axis direction.

According to one preferred embodiment, a honeycomb shaped pad is used. The honeycomb patterned pad configuration provides the best overall performance compared with all the other shapes in two areas: 1) the simple hexagon shape of such a pad is easy to be cut and produced efficiently in large quantities; and 2) it is easy to control the gap dimension between any two pads. The hexagon shaped pad with unequal side lengths (with four sides longer than the other two sides) was found to be suitable for the applications. Other pad shapes of equal or unequal side lengths, such as triangle and parallelogram, were also investigated and could also be utilized to form an anti-cutting amour.

Figure 2B:
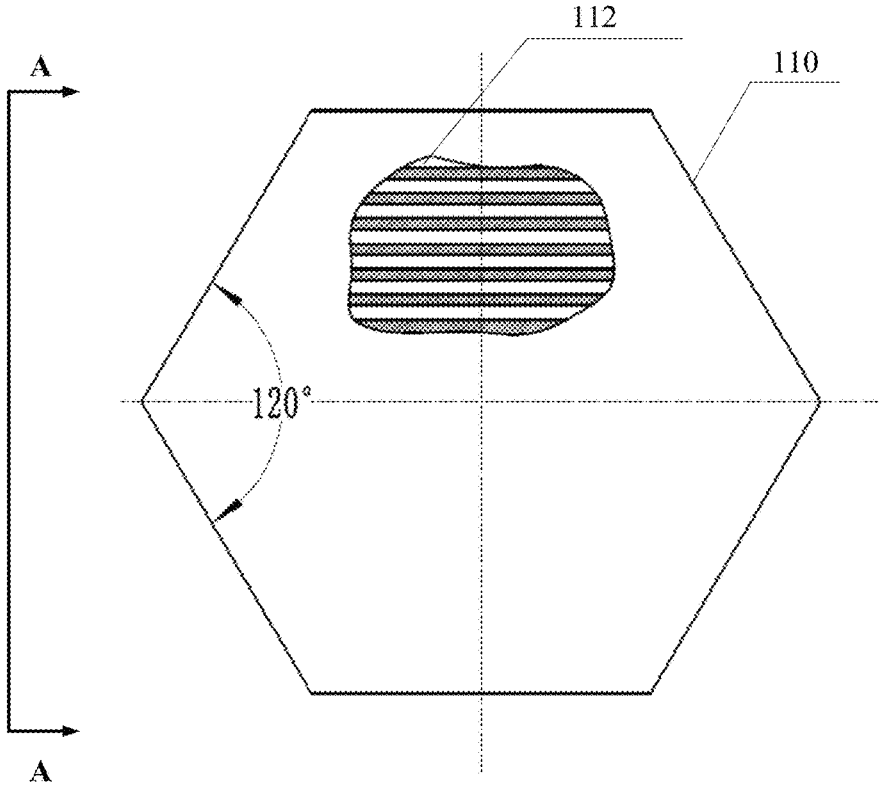
FIG. 2B is a plane view of an individual hexagon shaped pad with equal side lengths using a radial steel cord ply with all the cords oriented in parallel to the airbag axis direction.
Figure 2C:
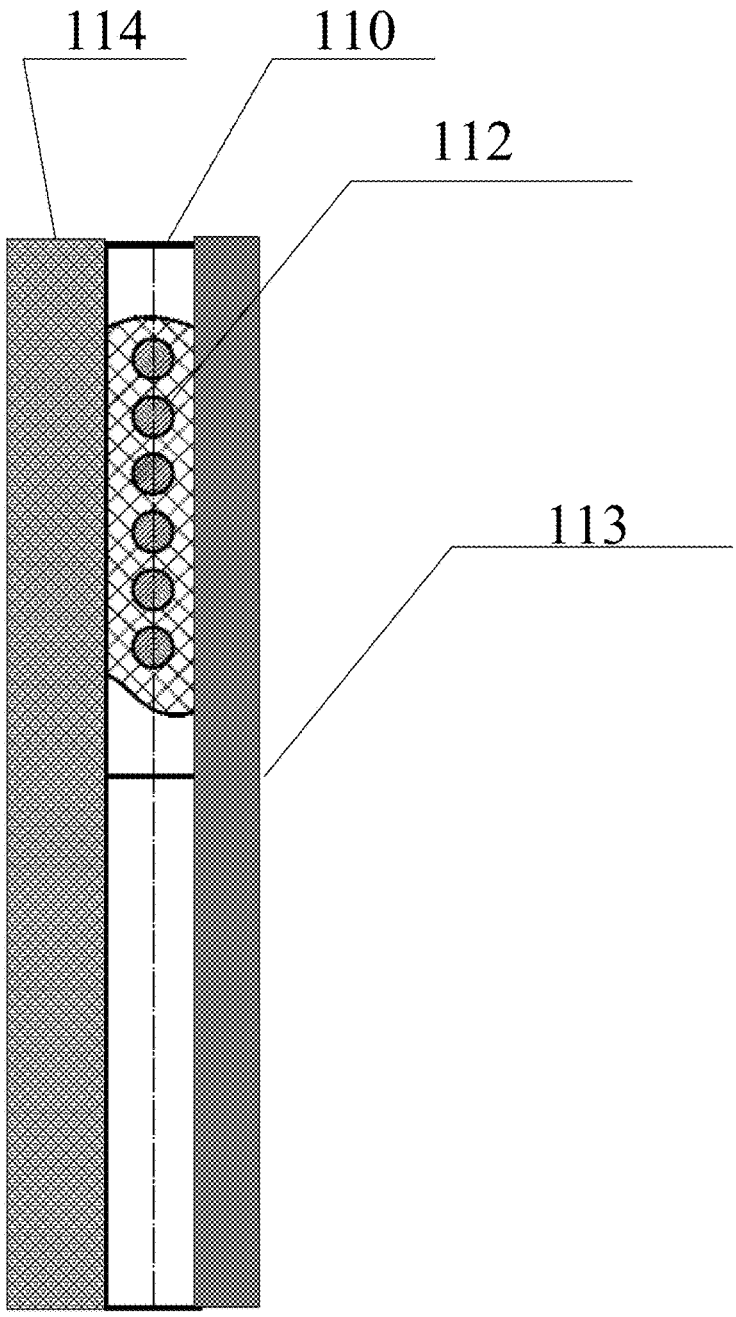
FIG. 2C is a cross section view of the individual hexagon shaped pad shown in FIG. 2B, sandwiched by an airbag middle section layer at one side and a rubber sheet at another side.

Referring now to FIG. 2A through FIG. 2C, an anti-cutting airbag 200 is illustrated with multiple hexagon shaped pads 110 with equal sides covering the surface of the airbag 200 middle section. The hexagon shaped pads 110 of a radial steel cord ply 112 are oriented so that all the cords are parallel to the airbag 200 axis direction. Gaps 111 are left between any two adjacent disconnected pads 110. In one embodiment, gaps 111 have a controlled dimensional size.

Referring to FIG. 2C, the individual pad 110, in which a radial steel cord ply 112 is sandwiched and pressed by two thin layers of rubber sheets, is attached on top of the surface layer 114, similar to a conventional ship launching airbag 100 surface layer, and beneath a cover rubber sheet 113 before going through vulcanization.

Figure 2D:
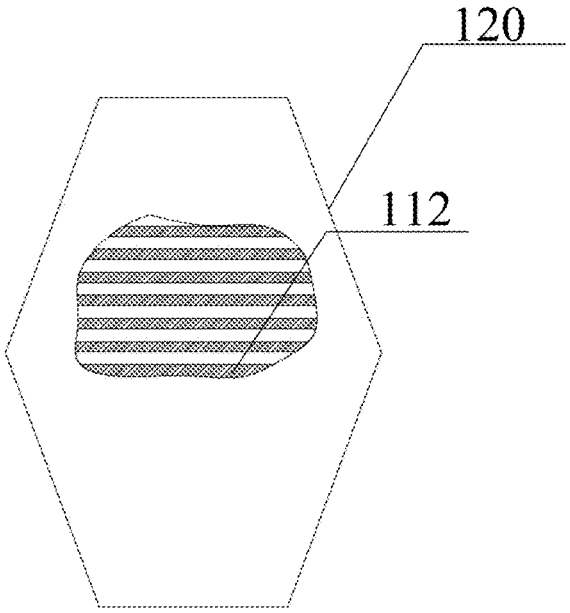
FIG. 2D is a plane view of an individual hexagon shaped pad with unequal side lengths (with four sides longer than the other two sides) using a radial steel cord ply with all the cords oriented in parallel to the airbag axis direction.

FIG. 2D is an alternative hexagon shaped pad 130 configuration with unequal side lengths, which could be a replacement of the pad 110.

Figure 2E:
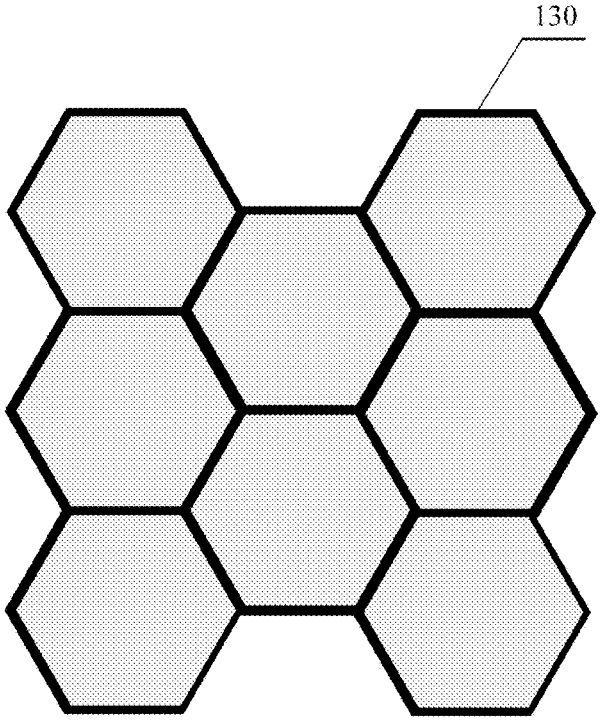
FIG. 2E is a plane view of a framing tool for placing designed hexagon pads at the middle section surface of airbag and with correct gap dimensions.

FIG. 2E illustrates a dimensional template 130 with the exact same size for placing each hexagon shaped pad 110 inside each opening of the template 130 in order to maintain the correct gap size between pads 110 during the fabrication process.

A typical anti-cutting airbag 200 fabrication process for adding hexagon shaped anti-cutting pads 110 with a covering rubber sheet 113 can be described as the following steps:

1. Utilizing a pressed cutting machine to produce the required number of pads 110 out of a large radial steel cord ply sheet;

2. Placing the designed template 130 on the surface of the airbag 100 middle section after the fabrication process of a conventional ship launch airbag 100 is complete;

3. Placing hexagon shaped pads 110 inside the openings of the template 130 until the entire middle section is covered with these pads 110;

4. Using designed rubber strips to fill all the gaps 111;

5. Utilizing a pressing tool to smoothen the top surface of the pads 110 and the gaps 111 and to expel air out these gaps;

6. Covering the surface of the pads 110 and the gaps 111 with a rubber sheet 114;

7. Utilizing the same pressing tool to smoothen the rubber sheet 114 surface and to expel air out between the sheet 114 bottom and the surface of these pads 110 and these gaps 111;

8. After going through vulcanization, the fabrication process of an anti-cutting airbag 200 is then completed.

In one embodiment, multiple layers of steel cord ply are used within one pad, with one rubber sheet in between any two layers and one rubber sheet at the top surface, to cover the entire airbag middle section. In such multiple layer configurations, the same cord ply configuration could be used for all the cord ply sheets with all the cords oriented in the same direction as the airbag axis.

Figure 3A:
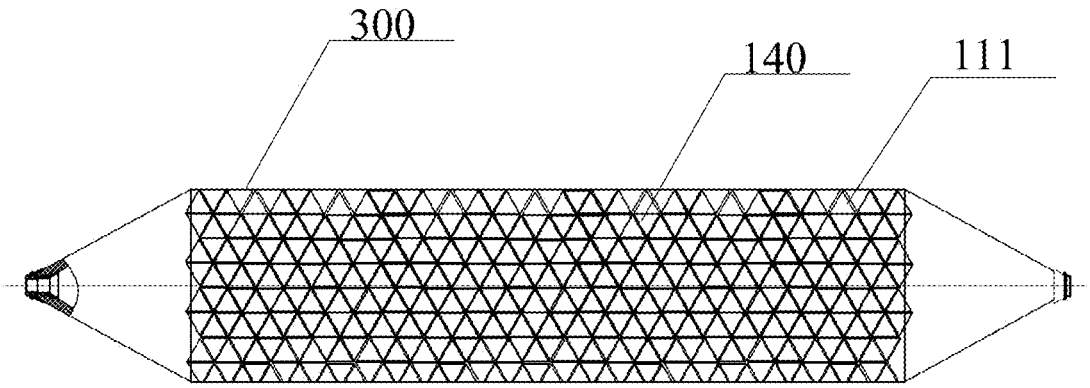
FIG. 3A is a side view of an anti-cutting airbag with an equilateral triangle pad layout and with controlled gaps in between pads.
Figure 3B:
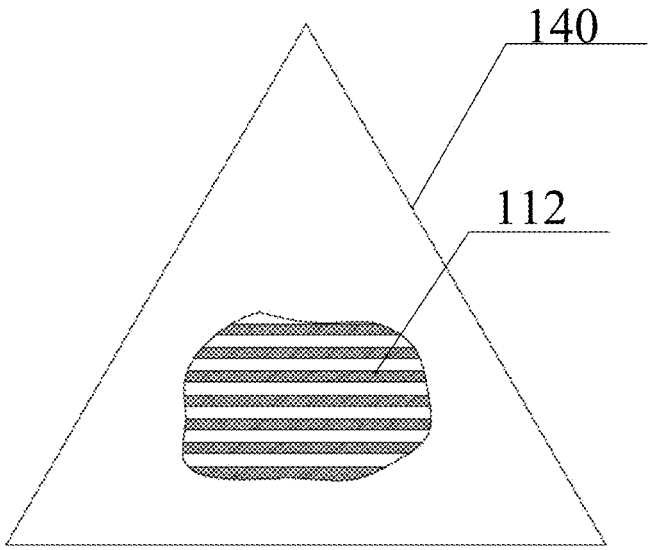
FIG. 3B is a plane view of an individual equilateral triangle shaped pad with all the steel cords oriented in parallel to the airbag axis direction.

Referring to FIG. 3A through FIG. 3B, another embodiment of anti-cutting airbag 300 with multiple equilateral triangle shaped pads 140 using a radial steel cord ply 112 is illustrated. A radial steel cord ply 112 sheet is cut into multiple equilateral triangle shaped pads 140. The equilateral triangle shaped pads 140 are placed on the surface of the airbag 300 middle section. The steel cords of all the pads 140 are oriented in parallel to the airbag 300 axis direction. Gaps 111, with a designed dimensional size, are left between any two adjacent disconnected pads 140.

Figure 4A:
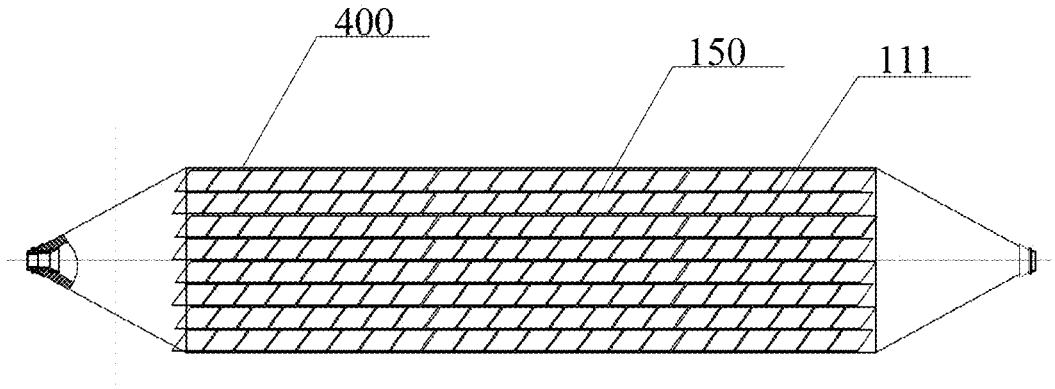
FIG. 4A is a side view of an anti-cutting airbag with an individual parallelogram shaped pad layout and with controlled gaps in between pads.
Figure 4B:
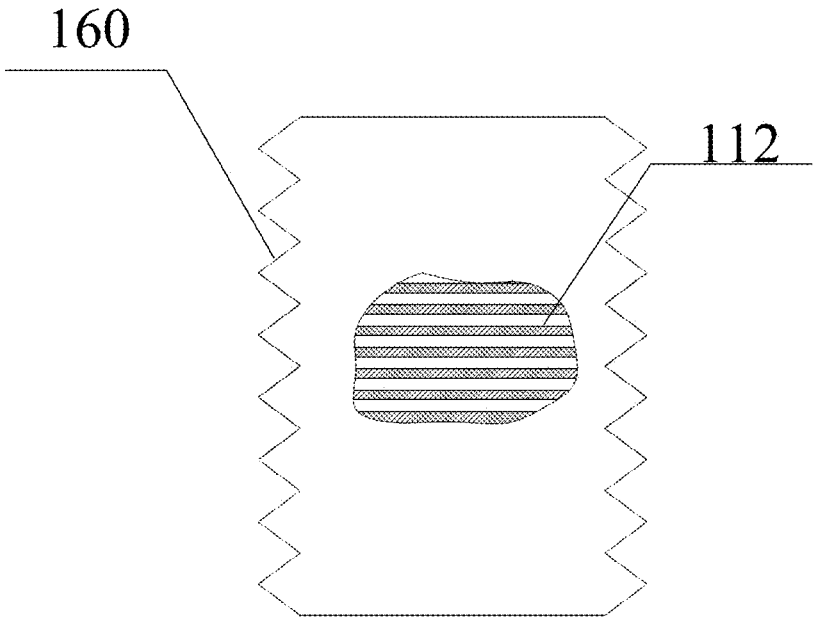
FIG. 4B is a plane view of an individual parallelogram shaped pad with all the steel cords oriented parallel to the airbag axis direction.

Referring to FIG. 4A through FIG. 4B, another embodiment of anti-cutting airbag 400 with multiple parallelogram shaped pads 150 using a radial steel cord ply 112 is illustrated. A large radial steel cord ply 112 sheet is cut into multiple parallelogram shaped pads 150. The parallelogram shaped pads 150 are placed on the surface of the airbag 400 middle section. The steel cords of all the pads 150 are oriented in parallel to the airbag 400 axis direction. Gaps 111, with a designed dimensional size, are left between any two adjacent disconnected pads 150.

Figure 5A:
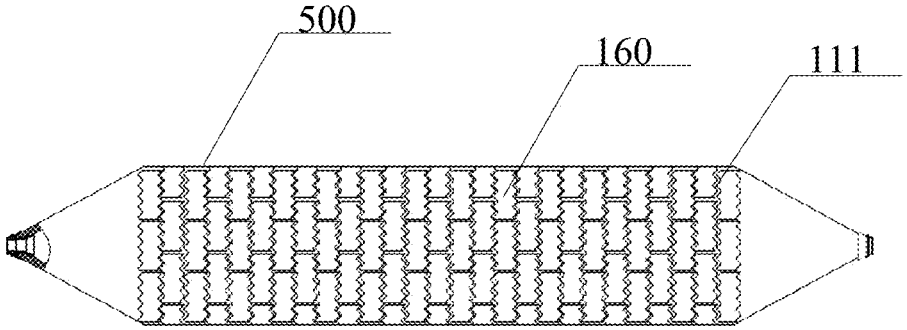
FIG. 5A is a side view of an anti-cutting airbag with a rectangular shaped pad layout and with controlled gaps in between pads.
Figure 5B:
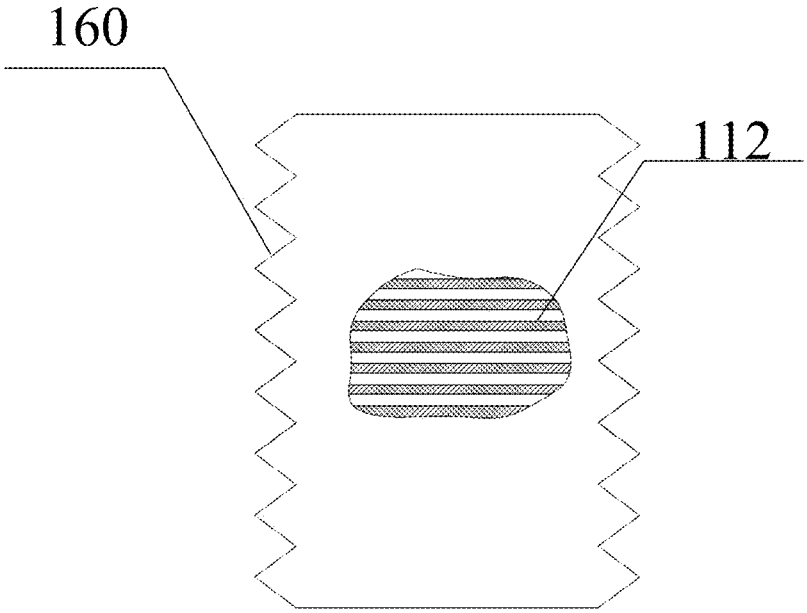
FIG. 5B is a plane view of an individual rectangle shaped pad with all the steel cords oriented parallel to the airbag axis direction and in a staggered pattern for two longer sides.

Referring to FIG. 5A through FIG. 5B, another embodiment of anti-cutting airbag 500 with multiple rectangular shaped pads 160 using a radial steel cord ply 112 is illustrated. A large radial steel cord ply 112 sheet is cut into multiple rectangular shaped pads 160. The rectangular shaped pads 160 are placed on the surface of the airbag 500 middle section. The steel cords of all the pads 160 are oriented in parallel to the airbag 500 axis direction. Gaps 111, with a designed dimensional size, are left between any two adjacent disconnected pads 160.

If rectangle shape is chosen, such pads should be cut into a staggered-pattern shape for two vertical sides in order to avoid the formation of a straight gap perpendicular to the airbag axis which may be vulnerable to a cutting.

Figure 6:
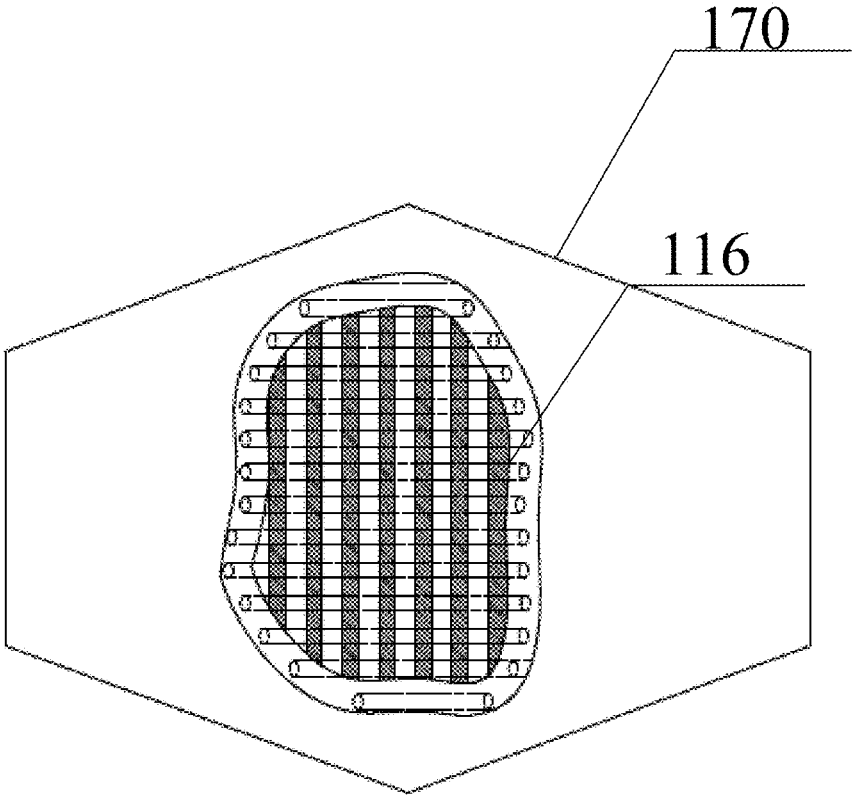
FIG. 6 is a plane view of an individual hexagon shaped pad with unequal side lengths using a biased steel cord ply.

A biased steel cord ply sheet may also be used for the anti-cutting armor. Referring to FIG. 6, a honeycomb patterned pad 170 configuration with a biased steel cord ply sheet 116 is used for the pads. Under this configuration, the airbag stiffness in the circular direction will increase proportionally with the dimension of such pad in circular direction. Therefore the pad size in the circular direction has to be small enough and the gaps have to be large enough in order to reduce the increased circular stiffness for the airbag. According to one embodiment, the longest side perpendicular to airbag axis direction of a hexagon shaped pad using biased steel cord ply sheet is limited to be less than 150 mm or half foot, and the minimum gap size is larger than 6% of a pad's maximum dimension in the airbag circular direction.

Although a preferred embodiment of an anti-cutting airbag assembly in accordance with the present invention has been described herein, those skilled in the art will recognize that various substitutions and modifications may be made to the specific features described without departing from the scope and spirit of the invention as recited in the appended claims.

What is claimed is:

1. An anti-cutting airbag assembly, comprising:

a tubular middle section comprising of a plurality of layers of fiber meshes and rubber sheets;

a plurality of shaped pads covering over the entire surface of the middle section, wherein the plurality of shaped pads are disconnected with each other by designed gaps, each pad comprises steel cord ply, the steel cords of each pad are oriented in parallel with airbag axis direction, the gap is not perpendicular to the airbag axis; and a layer of rubber sheet placed on top of all the pads over the entire middle section.

2. The anti-cutting airbag assembly according to claim 1, wherein each pad comprises a piece of radial steel cord ply sheet having a layer of steel cords laid closely side by side in parallel and then sandwiched and pressed together by two un-vulcanized thin rubber sheets.

3. The anti-cutting airbag assembly according to claim 2, wherein the pad comprises two or more layers of radial steel cord ply sheets, one layer on top of another separated by a layer of rubber sheet in between, and then sandwiched and pressed together by two un-vulcanized thin rubber sheets, wherein each layer of radial steel cord ply sheet having a layer of steel cords laid closely side by side in parallel.

4. The anti-cutting airbag assembly according to claim 1, wherein a particular shaped pad comprises one of the following shapes: rectangle, equilateral triangle, parallelogram, hexagon of equal sides, and hexagon of unequal sides (with four sides longer than the other two), wherein the rectangle shaped pad having steel cords parallel to the narrow sides of the pad and cut into a staggered pattern at two longer sides of the rectangle in order to avoid formation of a gap perpendicular to the airbag axis.

5. The anti-cutting airbag assembly according to claim 2 wherein the dimension of the pad parallel to airbag axis direction is less than 300 mm or 1 foot.

6. The anti-cutting airbag assembly according to claim 2 wherein size of the gap is larger than 4% of the maximum pad dimension in the airbag axis direction.

7. The anti-cutting airbag assembly according to claim 1 wherein all gaps are filled with rubber strips before being covered with a layer of rubber sheet.

8. The anti-cutting airbag assembly according to claim 1, wherein each pad comprises a piece of biased steel cord ply sheet having two layers of steel cords crossly knitted as one and then sandwiched and pressed together by two un-vulcanized thin rubber sheets.

9. The anti-cutting airbag assembly according to claim 8 wherein the dimension of the pad perpendicular to airbag axis direction is less than 150 mm or half foot.

10. The anti-cutting airbag assembly according to claim 8 wherein size of the gap is larger than 6% of the maximum pad dimension in the airbag circular direction.

11. An anti-cutting airbag assembly, comprising:

a tubular middle section comprising of a plurality of layers of fiber meshes and rubber sheets; and a plurality of shaped pads covering over the entire surface of the middle section, wherein the plurality of shaped pads are properly oriented, and are disconnected with each other by a gap, wherein each pad comprises steel cord ply.

12. The anti-cutting airbag assembly according to claim 11, wherein each pad comprises a piece of radial steel cord ply sheet having a layer of steel cords laid closely side by side in parallel and then sandwiched and pressed together by two un-vulcanized thin rubber sheets.

13. The anti-cutting airbag assembly according to claim 12, wherein each pad comprises two or more pieces of radial steel cord ply sheets, one piece on top of another separated by a layer of rubber sheet in between, and then sandwiched and pressed together by two un-vulcanized thin rubber sheets, wherein each piece of radial steel cord ply sheet having a layer of steel cords laid closely side by side in parallel.

14. The anti-cutting airbag assembly according to claim 11, wherein a particular shaped pad comprises one of the following shapes: rectangle, equilateral triangle, parallelogram, hexagon of equal sides, and hexagon of unequal sides (with four sides longer than the other two), wherein a rectangle shaped pad having steel cords parallel to the narrow sides of the pad and laid out in a staggered pattern at two longer sides of the rectangle in order to avoid formation of a gap perpendicular to the airbag axis.

15. The anti-cutting airbag assembly according to claim 12 wherein the dimension of the pad parallel to airbag axis direction is less than 300 mm or 1 foot.

16. The anti-cutting airbag assembly according to claim 12 wherein size of the gap is larger than 4% of the maximum pad dimension in airbag axis direction.

17. The anti-cutting airbag assembly according to claim 11 wherein all gaps are filled with rubber strips before being covered with a layer of rubber sheet.

18. The anti-cutting airbag assembly according to claim 11, wherein each pad comprises a piece of biased steel cord ply sheet having two layers of steel cords crossly knitted as one and then sandwiched and pressed together by two un-vulcanized thin rubber sheets.

19. The anti-cutting airbag assembly according to claim 18 wherein the dimension of the pad perpendicular to airbag axis direction is less than 150 mm or half foot.

20. The anti-cutting airbag assembly according to claim 18 wherein the size of the gap is larger than 6% of the maximum pad dimension in airbag circular direction.

21. The anti-cutting airbag assembly according to claim 11 wherein the proper orientation of the pads comprising placing the steel cords of the all pads in a direction parallel to the airbag axis and avoid formation of gaps between pads in a direction perpendicular to the airbag axis.

* * * * *